US005228146A

United States Patent [19]

Martell

[11] Patent Number: 5,228,146

[45] Date of Patent: Jul. 20, 1993

[54] FLUSHING DEVICE FOR TOILET

[76] Inventor: Steve Martell, 12201 S. Oglesby, Chicago, Ill. 60633

[21] Appl. No.: 814,100

[22] Filed: Dec. 26, 1991

[51] Int. Cl.[5] ..... E03D 5/10

[52] U.S. Cl. ..... 4/406; 4/DIG. 3

[58] Field of Search ..... 4/355, 381-384, 4/406, DIG. 3, 412

[56] References Cited

U.S. PATENT DOCUMENTS

| | | | |
|---|---|---|---|
| 342,495 | 5/1886 | Barker . | |
| 512,416 | 1/1894 | Voorhees . | |
| 568,995 | 10/1896 | Thwaites | 4/DIG. 3 |
| 939,123 | 11/1909 | Christy . | |
| 1,456,196 | 5/1923 | Staats | 4/406 |
| 2,813,274 | 11/1957 | Lewis et al. | 4/DIG. 3 |
| 3,090,967 | 5/1963 | Erhardt et al. . | |
| 3,345,649 | 10/1967 | Cabra | 4/412 X |
| 3,462,768 | 8/1969 | Lefebvre et al. | 4/412 X |
| 3,559,217 | 2/1971 | Johnson . | |
| 4,141,091 | 2/1979 | Pulvari | 4/DIG. 3 |
| 4,225,986 | 10/1980 | Mauk . | |
| 4,380,835 | 4/1983 | Yao . | |

*Primary Examiner*—Charles E. Phillips

*Attorney, Agent, or Firm*—McAndrews, Held & Malloy, Ltd.

[57] ABSTRACT

A tank toilet with a ball cock, flap valve, or other type of flush valve that is opened manually by lever operating a chain or the like is retrofitted and also made to operate electrically by installation in the tank of the toilet of a float that rides on a substantially vertical shaft that constrains motion of the float. The float is connected by a floating chain to the flush valve. When the flush tank is empty or nearly empty, the float sinks near the bottom of the shaft, where it is held in place by a sear as the tank fills. A solenoid located above the water level is connected to the sear by a lever. When the solenoid is energized, the sear is withdrawn, permitting the float to rise on the shaft, pull the plastic chain, and operate the flush valve. The electrically-operated flushing system does not interfere with manual operation of the flushing lever of the toilet.

4 Claims, 4 Drawing Sheets

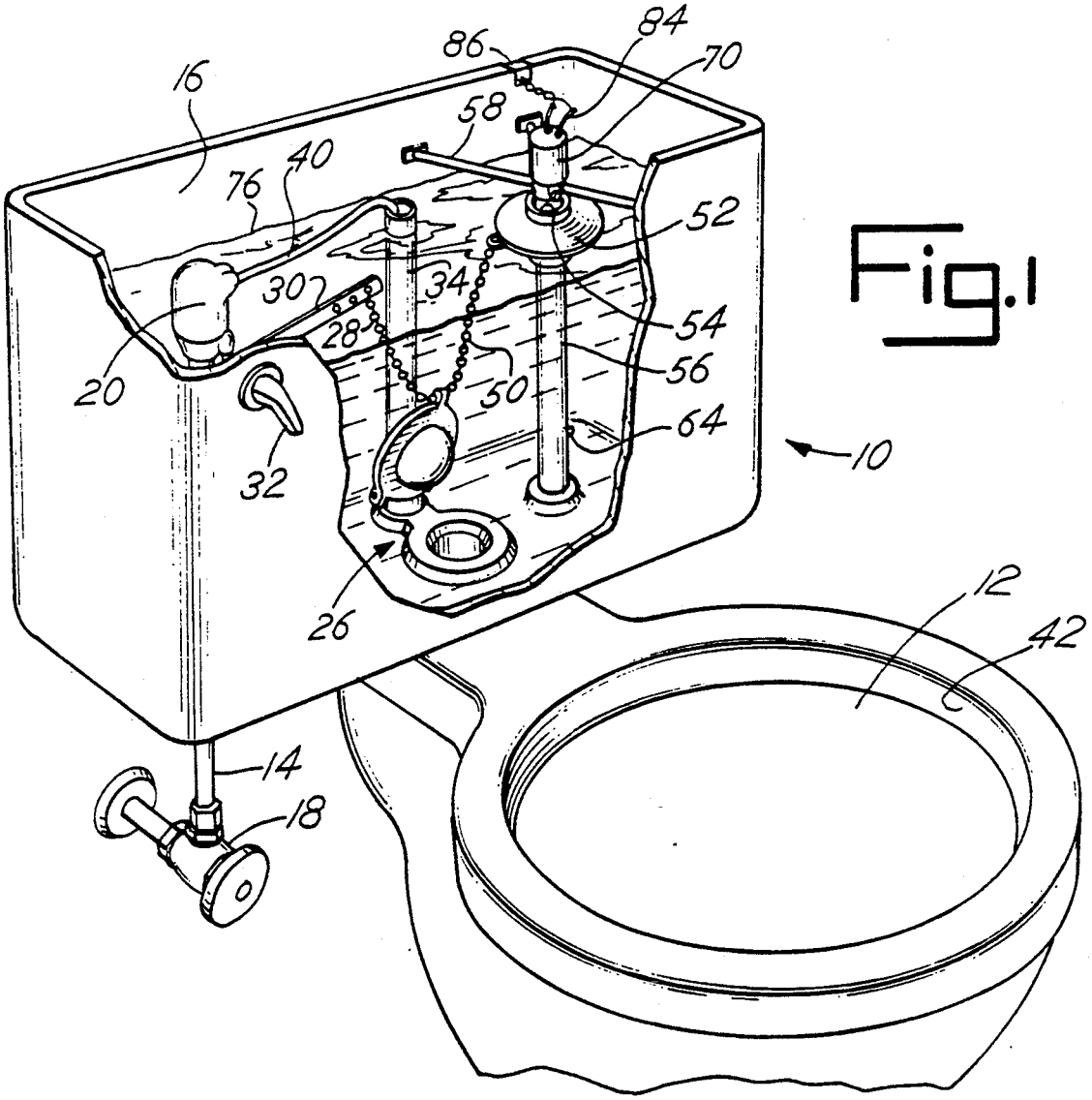
Fig.1
Fig.2
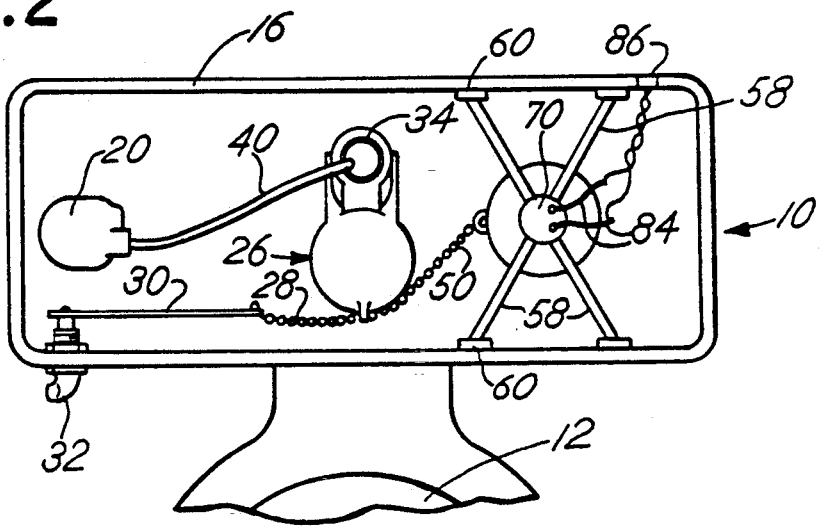

Fig. 5
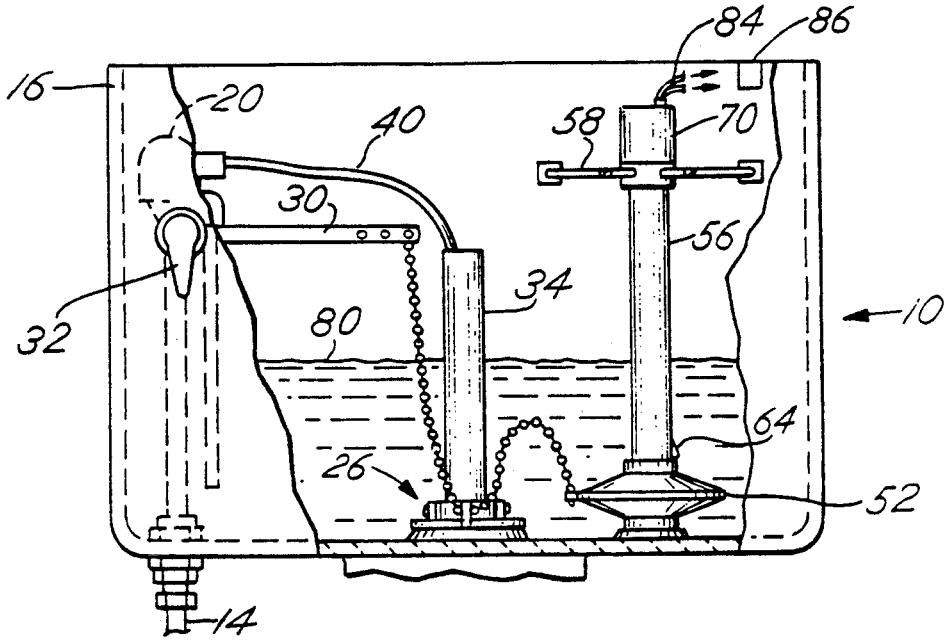
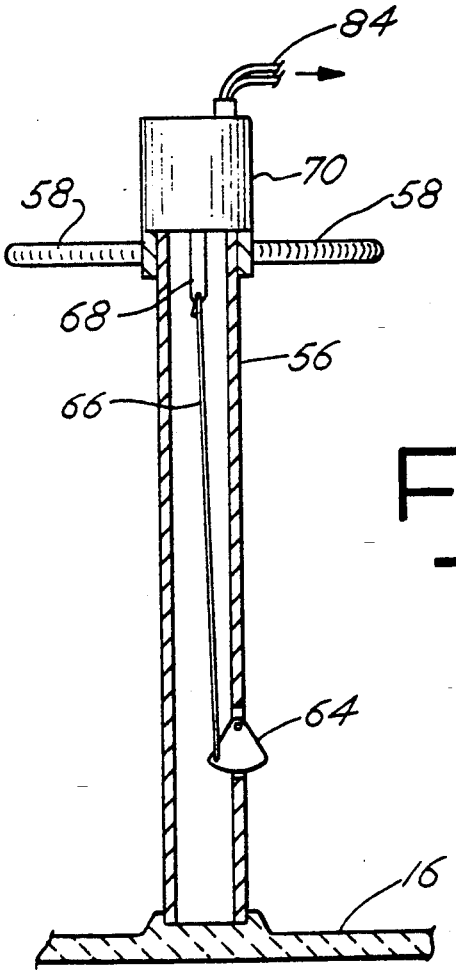
Fig. 6

FLUSHING DEVICE FOR TOILET

BACKGROUND OF THE INVENTION

This invention is related to toilets. In particular, it is a device for flushing a toilet electrically that may be used instead of the typical hand-operated flushing lever and that is particularly adapted to be added to an existing tank toilet having a ball-cock or other flush valve that is operated by a chain or the like.

Most existing residential toilets are tank toilets. That is, they include a tank of water that is emptied into a toilet bowl at a rate that is initially faster than the rate at which water can run out of the bowl. This raises the level of the water in the toilet bowl and causes a relatively rapid evacuation of the contents of the bowl when the level is high enough to break a siphon in the outlet from the bowl. This process requires a water tank that holds an appropriate amount of water in a location higher than the toilet bowl, means for filling the toilet bowl to a desired level, and means for emptying the tank into the bowl. It is useful to add means for preventing overflow of the tank, typically an overflow standpipe that is connected to the inside of the rim of the toilet to discharge water from under the rim of the bowl. The tank is connected to the toilet bowl by a conduit that typically has a relatively large diameter, of the order of inches. This lets the water tank empty into the bowl in a time of the order of seconds. The conduit is sealed in the tank by a ball cock or flap valve.

Normal operation of the flush cycle is as follows. With the tank filled with water to the desired level, a user works a lever that causes the ball cock or flap valve to be lifted by a chain or the like, opening the conduit from the tank to the bowl. Water rushes through the conduit to the bowl, lowering the level in the tank and raising the level in the bowl. A float-controlled valve or other valve that is sensitive to the level of water in the tank is opened by the lowered level, and water begins to flow into the tank as soon as the level of water in the tank starts to drop. A tube is typically connected from the float valve or other level-control valve to the standpipe to cause water to flow in the standpipe while the level-control valve is open. The water continues to flow into the bowl until it reaches a predetermined low level, at which point the flush valve closes. The main flushing action stops at this point as the tank begins to refill. While this happens, water continues to flow in the tube to the standpipe, maintaining the flow into the rim of the bowl to continue the rinsing action in the bowl and also provide a continuing input of water to the bowl while the tank is filling. Water flows into the tank until it reaches the predetermined level, at which point the float valve or other level-control valve shuts off the flow of water. The toilet is ready to repeat the cycle.

It is difficult to operate the typical tank toilet with a lever that is placed anywhere except on the tank. This location restricts bathroom designers who want to control the flushing of a toilet from locations other than the tank, and it also presents a problem to handicapped people who are confined to wheelchairs, especially if they are paraplegics. The location of the handle on the toilet also makes it difficult to equip a tank toilet to be flushed by a foot pedal. Mechanical linkages have been developed which enable tank toilets to be flushed by foot pedals, but these linkages tend to be complicated, difficult to clean, and easy to damage.

The desire to have a device that will flush a toilet by the use of electricity is not new. U.S. Pat. No. 342,495, entitled "Apparatus Governed by Electricity for Flushing Water Closets," was issued on May 25, 1886. It teaches a solenoid operated by a remote switch and connected to a lever or chain that lifts a ball cock to flush a toilet. The '495 patent is adapted to the tanks of the time that were located high in the air. It teaches no means for flushing the toilet manually, and is thus not readily adapted to be retrofitted to an existing toilet that is flushed manually.

Any device that is developed to make it easier for people, and especially handicapped people, to flush toilets or that makes it easier to flush tank toilets from remote locations will be most useful if it is adapted for installation in existing tank toilets without extensive modification of the existing flushing mechanisms. For many existing toilets that use lever-operated ball cock valves and are refilled by a valve controlled by a float at the end of a lever, it may be necessary to create room in the flush tank by substituting a flush valve that uses an integral level-control valve of the type that is sold as a replacement unit. The float-lever tank toilets have a relatively small amount of room in the tank to install the apparatus of the present invention, and most commercially available lever-operated float valves need most of the room in the top of the flush tank to provide enough moment on a lever arm to close the valve when the tank is full. In addition, any such device that is added to an existing toilet must not interfere with normal manual operation of the toilet, either as a matter of choice by a user or in case of electrical failure.

It is an object of the present invention to provide a remotely controlled flusher for a tank toilet.

It is a further object of the present invention to provide an electrically-operated flushing mechanism for a tank toilet.

It is a further object of the present invention to provide a remotely operable flushing unit that is electrically operated for a tank toilet.

It is a further object of the present invention to provide a remotely operable flushing unit that can be installed in an existing tank toilet having a ball cock, flap valve, or other flush valve operated by a chain.

It is a further object of the present invention to provide a remotely operable flushing unit for a tank toilet that operates in conjunction with an existing manually-operated flushing device in the toilet.

Other objects will become apparent in the course of a detailed description of the invention.

SUMMARY OF THE INVENTION

A tank toilet with a ball cock or other type of flush valve operated by a chain is made operable electrically by installation in the tank of the toilet of a float that rides on a vertical shaft that constrains motion of the float. The float is connected by a floating chain to the ball cock, flap valve, or other flush valve. When the tank is empty or nearly empty, the float sinks to or nearly to the bottom of the shaft, where it is held in place by a sear as the tank fills. A solenoid located above the water level is connected to the sear by a lever. When the solenoid is energized, the sear is withdrawn, permitting the float to rise on the shaft, pull the plastic chain, and operate the flushing valve. The electrically-operated flushing system does not interfere with manual operation of the flushing lever of the toilet.

BRIEF DESCRIPTION OF THE DRAWINGS

FIG. 1 is a cutaway perspective view of a tank toilet that includes the remote operating feature of the present invention.

FIG. 2 is a plan view of a tank toilet containing the present invention.

FIG. 5 is a cutaway side view of a nearly empty tank that is refilling.

FIG. 6 is a side view of the shaft showing the sear and solenoid.

DETAILED DESCRIPTION OF THE INVENTION

Figure 3:
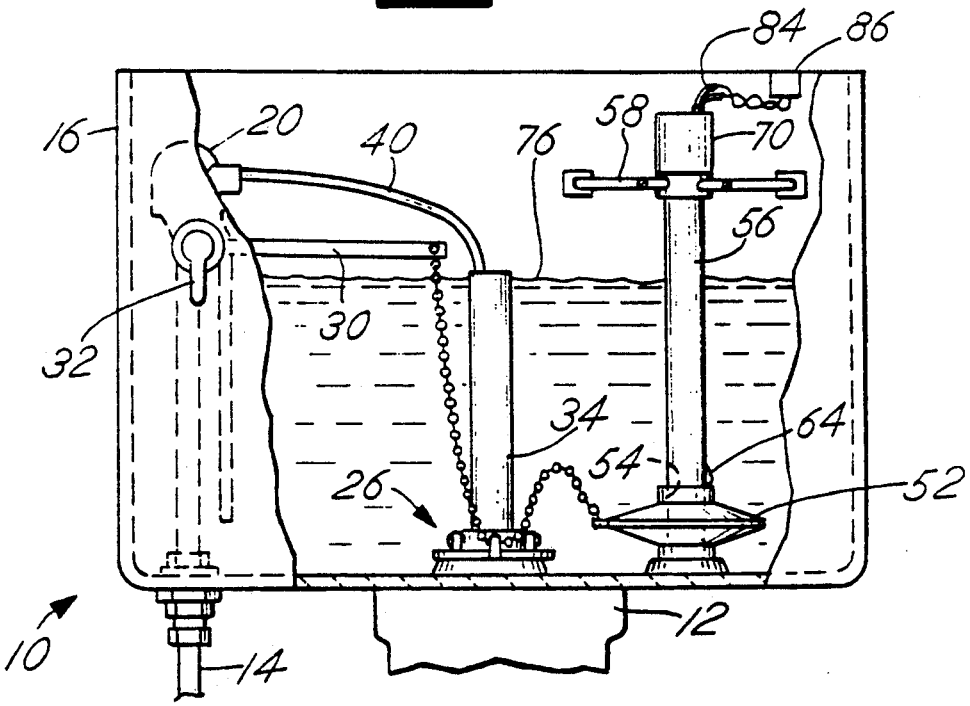
FIG. 3 is a cutaway side view of a toilet tank equipped for the practice of the present invention when the tank is full.

FIG. 1 is a cutaway perspective view of a tank toilet that includes the remote operating feature of the present invention, and FIG. 2 is a plan view of a tank toilet containing the present invention with the top removed from the tank. In FIGS. 1 and 2, a tank toilet 10 is connected to a bowl 12 to supply water to flush the bowl 12. A water pipe 14 is connected to a tank 16 to supply water through a water inlet valve 18. The water pipe 14 is connected to a fill valve 20 that is operated by the level of water in the tank 16. A flush valve 26 keeps water in the tank 16 when it is closed and lets water into the bowl 12 when it is open. The flush valve 26 may be a ball cock or a flap valve, either of which is opened by being lifted by a chain 28 and is closed by gravity when the water level gets below part of the flush valve 26.

The chain 28 is connected to a lever 30. A handle 32 located outside the tank 16 is pivoted to rotate and operate the lever 30 so as to pull the chain 28, open the flush valve 26, and flush the toilet. An overflow standpipe 34 is connected to the fill valve 20 by a tube 40, which supplies water to the standpipe 34 whenever the fill valve 20 is opened by a drop in the water level. The standpipe 34 is connected to the bowl 12 so as to empty water to the bowl 12 if the fill valve 20 malfunctions and sticks open, and it is also arranged to supply water to the inside of the rim 42 to rinse it during flushing and filling. All of the elements described above function independently of the present invention.

The present invention adds an additional way to operate the flush valve 26 and flush the toilet. It comprises a linkage or chain 50 that is connected to the flush valve 26 and to a float 52, which is preferably made with a central cylindrical opening 54 that guides the float 52 on a shaft 56. In the preferred embodiment, the chain 50 is made of a plastic or other substance that floats in water so that it will rise to be clear of the flush valve 26 when the float 52 is near the bottom of the shaft 56. The shaft 56 is preferably connected to the tank 16 by an X-bracket 58 that is sized to be wedged into the tank 12 and held in place by friction between the arms 60 of the X-bracket 58 against the inside of the tank 16. This is a matter of design choice; the shaft 56 could also be secured by other means to the wall of the tank 12, or it could be secured to the bottom of the tank 12. The position of the float 52 is controlled by the level of water in the tank 16 and also by a sear 64 that is set in the shaft 56. A rod 66 is connected to the sear 64 and to a plunger 68 of a solenoid 70.

Figure 4:
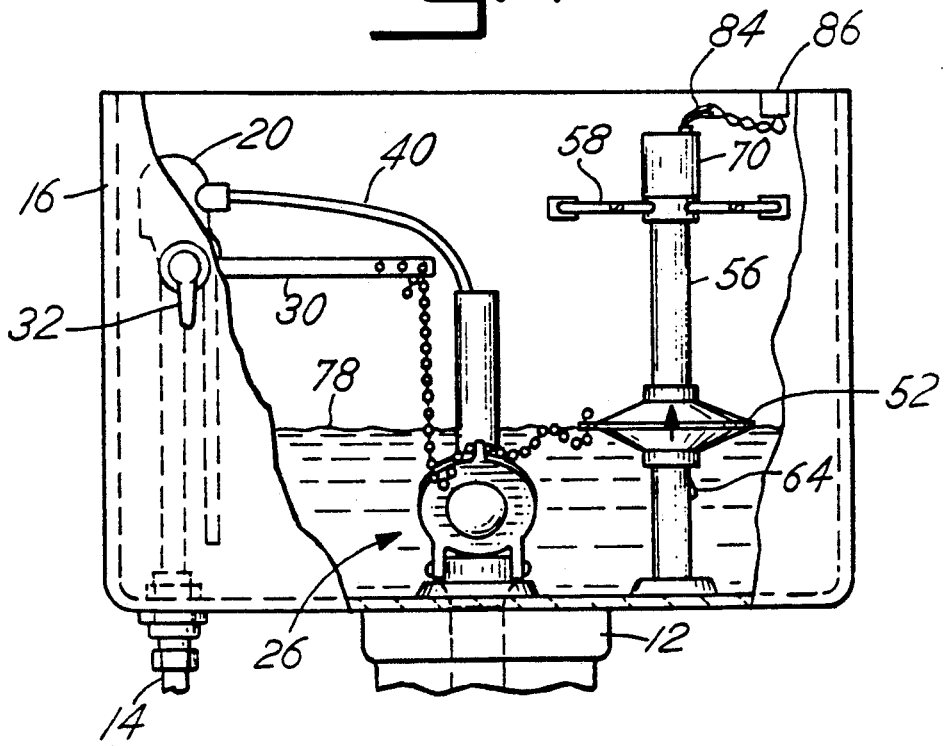
FIG. 4 is a cutaway side view of a nearly empty tank in a toilet that is flushing.

Operation of the invention will be seen best by considering several different conditions, as follows. FIG. 3 is a cutaway side view of a toilet tank equipped for the practice of the present invention when the tank is full and ready to flush; FIG. 4 is a cutaway side view of a nearly empty tank that is flushing the toilet; and FIG. 5 is a cutaway side view of a nearly empty tank that is refilling. In FIGS. 3, 4, and 5, a time sequence of operation begins with FIG. 3, which shows a tank 16 that is full of water to a water level 76 and in which the flush valve 26 is closed. The water inlet valve 18 is open and typically stays that way unless it is necessary to shut off the water supply to service the toilet.

In FIG. 3, the solenoid 70 has been energized, operating the sear 64 and releasing the float 52. The flush valve 26 is lifted and opened by the chain 50. Water starts to run into the bowl 12, the water level 76 drops, and the float 52 follows the water level 56, dropping to the level 78 shown in FIG. 4. The fill valve 20 is open in FIG. 4, letting water enter the tank 16, but at a rate slower than the rate at which the water flows into the bowl 12. The flush valve 26 is seen to be open in FIG. 4, and the float 52 has dropped past the sear 64. As the water level 78 drops farther, it will finally produce the condition of FIG. 5, where the flush valve 26 has closed at the water level 80. Water will no longer pass the flush valve 26 to flow into the bowl 12, and the tank 16 starts to refill. The float 52 will rise with the water level 80 until it reaches the sear 64, which holds it in position as the water level 80 reaches the predetermined level that restores the conditions of FIG. 3. The sear 64 may be about a quarter of a circular disc of plastic or brass that is hinged to project in the path of the float 52 as it drops down the shaft 56 and is held there by the weight of the rod 66 and plunger 68. The weight of the float 52 pushes the sear 64 aside on the way down but the float 52 is caught by the sear 64 as the water level rises.

FIG. 6 is a side view of the shaft showing the sear and solenoid with the float 52 removed for clarity. In FIG. 6, the shaft 56 is supported by the X-bracket 58, although it could equally as well be supported by bolting it or gluing it to the bottom of the tank 16. The rod 66 is connected to the plunger 68 of the solenoid 70, which is connected to the shaft 56. When current in wires 86 energizes the solenoid 70, the solenoid 70 pulls up, drawing the sear 64 inside the shaft 56 and releasing the float 52.

Figure 7:
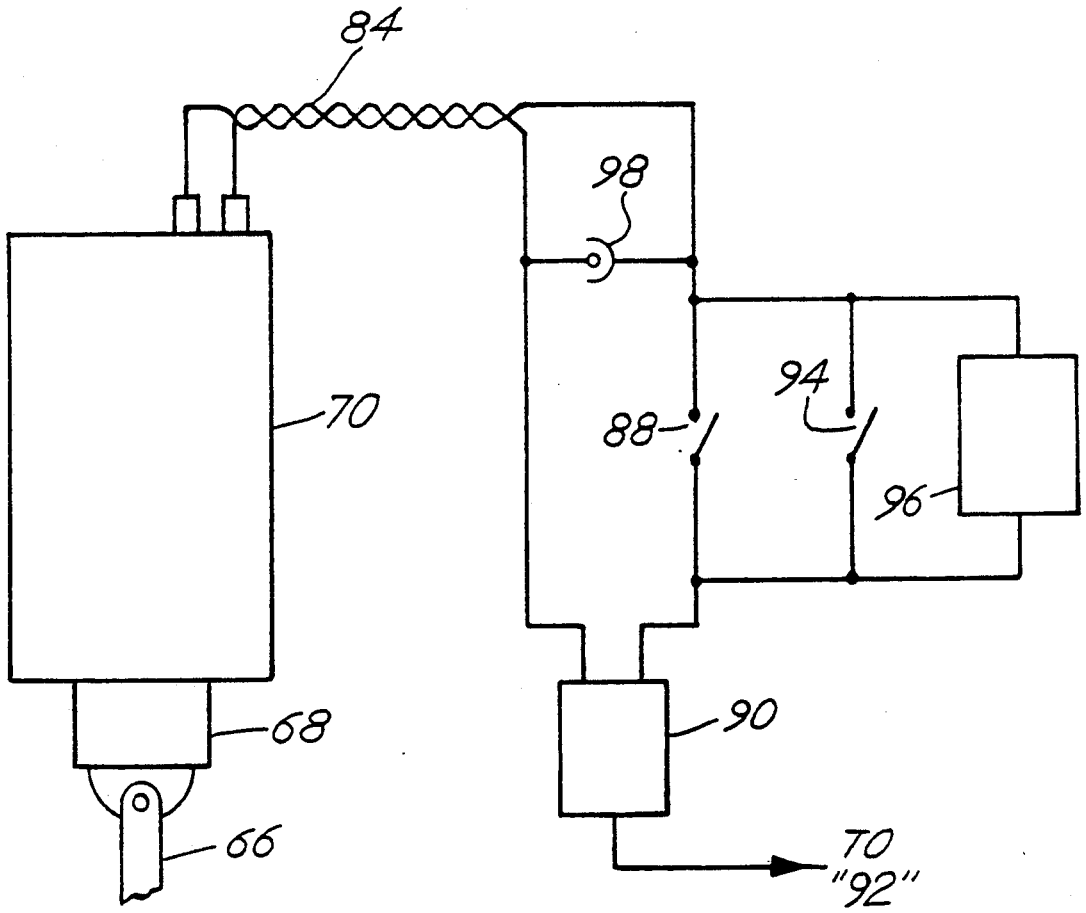
FIG. 7 is a schematic diagram of electrical connections for the operation of the present invention.

FIG. 7 is a schematic diagram of electrical connections for the operation of the present invention. In FIG. 7, the solenoid 70 is connected by wires 84 to a switch 86. The wires 84 are secured to the tank 16 by a clip 88 that keeps them out of the water. The wires 84 are then connected to a secondary winding of a combination rectifier and transformer 90 which is preferably at a voltage of twelve volts or such as is needed to operate the solenoid 70. The primary winding of the transformer 90 is connected to an ac power line 92. The switch 86 may be located anywhere within easy reach of a user of a toilet that is equipped with the flusher of the present invention.

It should be evident that additional switches 94 may be placed in parallel with the switch 86 if it is desired to provide the opportunity to flush the toilet from other remote locations. A remote-control unit 96 could also be connected to flush the toilet according to a time schedule, voice command, or other desired system of remote control. Such a feature may make the toilet much easier for a severely handicapped person to use and also easier for an attendant for such a person. An additional feature that is especially useful for a handicapped person is the connector 98 that allows a user to connect a battery briefly to energize the solenoid 70 even though there may be a power outage. This would work with either a dc or an ac solenoid. In an embodiment of the invention that was built and tested, the solenoid 70 was a dc solenoid that was operated from a combination rectifier and transformer 90. It would have been equally as effective to use an ac solenoid 70 and operate it on a low ac voltage such as 12 volts ac obtained from a transformer 90 that did not have a rectifier.

The foregoing description should make it clear that the improved flushing device of the present invention could be used to replace the handle 32, lever 30, and chain 28 of FIGS. 1-5. However, it is likely that the invention will be most useful as a retrofit for an existing tank toilet, to keep the handle 32, lever 30, and chain 28 and also add the system of the present invention to provide the capability of remote operation by operating a switch such as the switch 88.

The description of the invention given here in intended to enable the practice of the best mode of the invention known to the inventor at the time of filing. It should be taken as illustrative and not as limiting, and the scope of the invention should be taken as that of the appended claims and their equivalents.

I claim:

1. An apparatus for retrofit to a toilet having a tank and a flush valve to allow water to be passed to the toilet bowl, said apparatus providing an electrical flush while also allowing an existing manually operated flushing mechanism to function, the apparatus comprising:

a float and means for mounting said float so that said float is constrained to move only vertically in the tank in response to the rise and fall of the water level in the tank upon respectively closing and opening of said flush valve, a linkage connected at one end to said float and connected at a second end to said flush valve to operate the flush valve in response to said constrained vertical movement of the float, means for holding the float in said low position so that said flush valve will close;

said linkage being of such length that with said float in said low position said linkage will not exert an opening force on said flush valve and with said float in a position higher than said low position said linkage will cause an opening of said flush valve;

a solenoid connected to the means for holding the float so as to release the float when the solenoid is energized;

means for energizing the solenoid;

said means for holding including a sear that is passed by the float when the float descends and that holds the float in said low position when the water level rises past the float;

whereby when said solenoid is actuated with the tank full said sear will release said float, which float will rise due to its buoyancy and cause said linkage to pull said flush valve to an open position for flushing said toilet.

2. The apparatus of claim 1 wherein said linkage comprises a plastic chain which will float in a water environment.

3. The apparatus of claim 1 wherein the means for mounting the float comprises a substantially vertical shaft upon which the float moves.

4. The apparatus of claim 1 wherein the solenoid is connected to the sear by a rod.

* * * * *